US005255759A

United States Patent [19]

Kasai et al.

[11] Patent Number: 5,255,759

[45] Date of Patent: Oct. 26, 1993

[54] APPARATUS FOR PREVENTING VIBRATION OF ELEVATOR TAIL-LINE

[75] Inventors: Hiroaki Kasai, Ibaraki; Masayuki Shigeta, Katsuta, both of Japan

[73] Assignee: Hitachi, Ltd., Tokyo, Japan

[21] Appl. No.: 907,042

[22] Filed: Jul. 1, 1992

[30] Foreign Application Priority Data

Jul. 1, 1991 [JP] Japan ..... 3-160461

[51] Int. Cl.[5] ..... B66B 17/12

[52] U.S. Cl. ..... 187/94; 187/1 R

[58] Field of Search ..... 187/1 R, 94

[56] References Cited

U.S. PATENT DOCUMENTS 4,664,229 5/1987 Obst ..... 187/1 R

FOREIGN PATENT DOCUMENTS 28183 1/1990 Japan .
223187 1/1990 Japan .
248391 2/1990 Japan .
2106584 4/1990 Japan .
2106586 4/1990 Japan .
2106587 4/1990 Japan .

*Primary Examiner*—Robert P. Olszewski
*Assistant Examiner*—Dean A. Reichard
*Attorney, Agent, or Firm*—Antonelli, Terry, Stout & Kraus

[57] ABSTRACT

An apparatus for preventing a vibration of an elevator tail-line having one stationarily held end and an opposite end connected to an elevator carriage to move together therewith. An absorber absorbs the vibration of the elevator tail-line, and a supporter bears a weight of the elevator tail-line to prevent the weight of the elevator-tail-line from being applied to the absorber so that the absorber does not bear the weight of the elevator tail-line.

20 Claims, 22 Drawing Sheets

APPARATUS FOR PREVENTING VIBRATION OF ELEVATOR TAIL-LINE

BACKGROUND OF THE INVENTION AND RELATED ART STATEMENT

The present invention relates to an apparatus for preventing a vibration of an elevator tail-line having one stationarily fixed end and a second end connected to an elevator carriage to move together therewith.

An apparatus for preventing a vibration of an elevator tail-line is disclosed in, for example, Japanese Patent Unexamined Publication No. 2-147583, wherein at least one of a carriage-side support point and carriage-path-side support point of the elevator tail-line extending between the carriage and a wall of the carriage-path is suspended from a support apparatus which is moveable on a slightly curved guide in a horizontal direction, and a frictional force generated on a reciprocating motion of the support apparatus absorbs the vibration of the elevator tail-line. A point on the elevator tail-line is connected by a steel cord to a motor room of the elevator instead of the support apparatus moveable on the slightly curved guide and the connected point on the elevator tail-line engages with a damper for absorbing the vibration of the elevator tail-line.

OBJECT AND SUMMARY OF THE INVENTION

An object of the present invention is to provide an apparatus for preventing a vibration of an elevator tail-line having a first stationarily fixed end and a second end connected to an elevator carriage to move together therewith, in which apparatus the vibration of the elevator tail-line is constantly absorbed.

According to the present invention, an apparatus for preventing a vibration of an elevator tail-line having a first stationarily fixed end and a second end connected to an elevator carriage to move together therewith comprises absorber means for absorbing the vibration of the elevator tail-line, and a support means for bearing a weight of the elevator tail-line to prevent the weight of the elevator tail-line from being applied to the absorber means so that the absorber means does not bear the weight of the elevator tail-line.

Since the support means bears the weight of the elevator tail-line to prevent the weight of the elevator tail-line from being applied to the absorber means so that the absorber means does not bear the weight of the elevator tail-line or the weight of the elevator tail-line is not transmitted to the absorber means, a vibration absorbing characteristic of the absorber means is not changed by a variation of weight distribution of the elevator tail-line caused by a descent and ascent of the elevator carriage. Therefore, the vibration of the elevator tail-line is absorbed constantly in the apparatus according to the present invention.

DETAILED DESCRIPTION OF PREFERRED EMBODIMENTS

Figure 1:
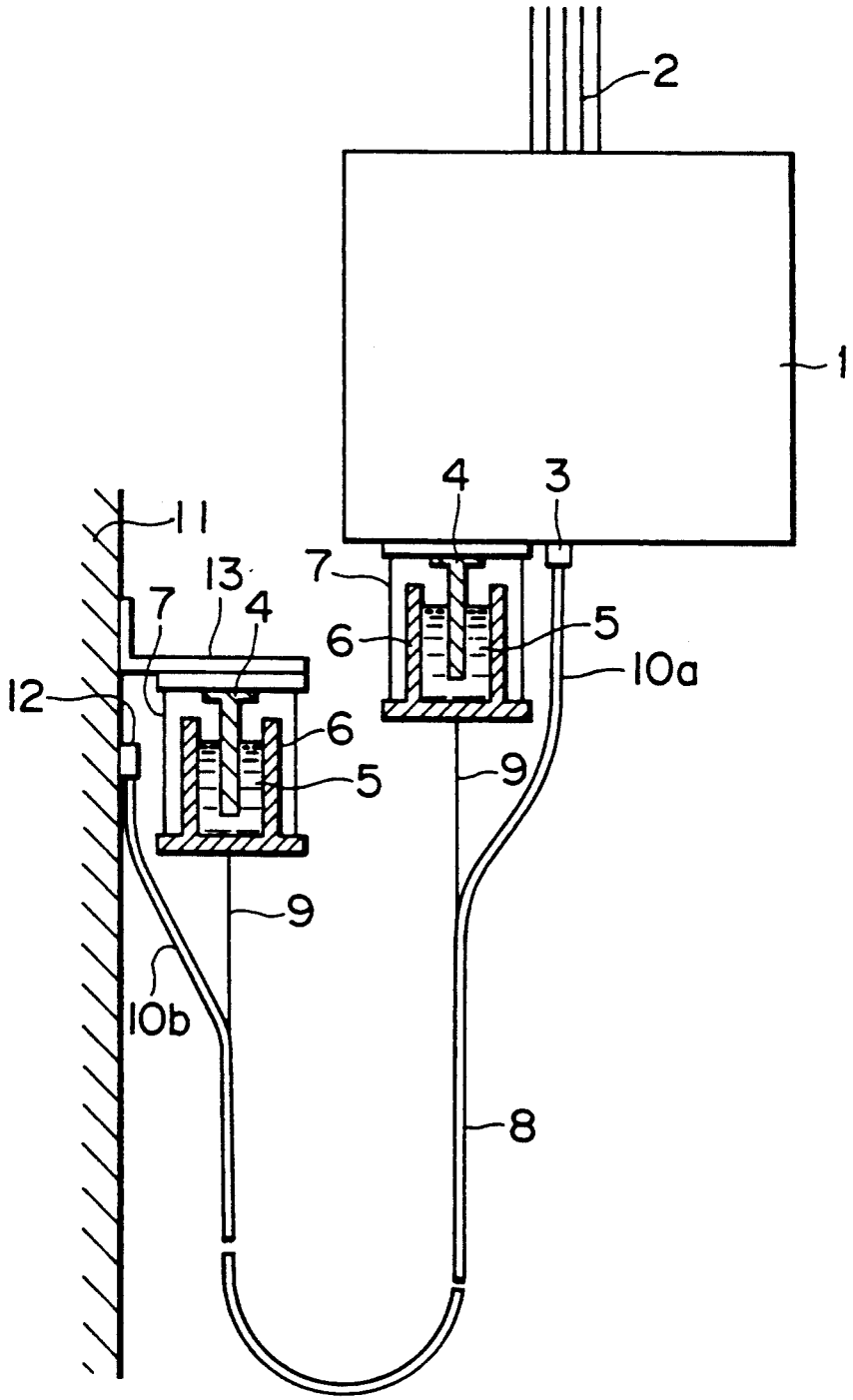
FIG. 1 is a partially cross-sectional view showing an embodiment of the apparatus according to the present invention.

As shown in FIG. 1, a carriage 1, supported by a rope 2, descends or ascends along a carriage path wall 11, with an end 10*a* of a tail-line 8 being connected to the carriage 1 through a junction box 3 under a bottom surface of the carriage 1, and with an opposite end 10*b* of the tail-line 8 being connected to a junction box 12 mounted on the carriage path wall 11. The tail-line 8 sags to form a loop between the junction box 3 and the junction box 12. One of containers 6 is suspended from the bottom surface of the carriage 1 through suspender cords 7 and contains a viscous fluid, solid grains or fluidal powder 5 as the claimed absorber means. An end of one of columns 4 is fixed to the bottom surface of the carriage 1 and an opposite end thereof extends into the viscous fluid, solid grains or powder 5. A plurality of electric wires and a plurality of steel cords 9 extend longitudinally in the tail-line 8 and are surrounded by an insulating cover of the tail-line 8. One of the steel cords 9 extends to the outside of the insulating cover of the tail-line 8 and is fixed to a bottom surface of the container 6 so that all of weight of the tail-line 8 is carried by the carriage 1 through the one of the steel cords 9 and the suspender cords 7 and the weight of the tail-line 8 is not transmitted to the viscous fluid, solid grains or powder 5. The steel cords 9 and the suspender cords 7 act as the claimed support means. The end 10*a* of the tail-line 8 has a sufficient length or loop for preventing a vibration of the tail-line 8 from being transmitted to the carriage 1 through the junction box 3. When a range in which the carriage 1 can descend and ascend along the carriage path wall 11 has an approximate length of 80 meters, the carriage 1 is arranged at an intermediate position of the range, and one end of the tail-line 8 is fixed to the intermediate position of the range on the carriage path wall 11, with a distance between top and bottom portions of a sagging loop of the tail-line 8 being about 42 meters. In this case, a weight of the tail-line 8 with a cross-sectional width of approximately 10 cm and a cross-sectional thickness of approximately 5 mm is about 80 kg and a natural frequency thereof in a horizontal direction is about 0.1 Hz.

When the tail-line 8 vibrates horizontally and the steel cord 9 is vibrated horizontally by the tail-line 8, the container 6 is vibrated horizontally together with the tail-line 8 and the steel cord 9 with a swing radius of a length of the suspender cords 7 so that a relative motion between the column 4 and the container 6 is generated. Since the viscous fluid, solid grains or powder 5 as the absorber means is arranged between the column 4 and the container 6, the vibrations of the container 6, the steel cord 9 and the tail-line 8 are absorbed by a flow loss of the viscous fluid, solid grains or powder 5 caused by the relative motion between the column 4 and the container 6.

Another one of the containers 6 is suspended from a bottom surface of a bracket 13 extending from the carriage path wall 11 through the suspender cords 7 and contains the viscous fluid, solid grains or powder 5 as the absorber means. An end of another one of the columns 4 is fixed to the bottom surface of the bracket 13 and another end thereof extends into the viscous fluid or solid grains or powder 5. One of the steel cords 9 extends to the outside of the insulating cover of the tail-line 8 and is fixed to the bottom surface of the container 6 under the bracket 13 so that all of weight of the tail-line 8 is carried by the carriage path wall 11 through the one of the steel cords 9 and the suspender cords 7 and the weight of the tail-line 8 is not transmitted to the viscous fluid, solid grains or powder 5. The end 10*b* of the tail-line 8 has a sufficient length or loop for preventing a vibration of the tail-line 8 from being transmitted to the carriage path wall 11 through the junction box 12.

When the tail-line 8 vibrates horizontally and the steel cord 9 is vibrated horizontally by the tail-line 8, the container 6 is vibrated horizontally together with the tail-line 8 and the steel cord 9 with the swing radius of the length of the suspender cords 7 so that the relative motion between the column 4 and the container 6 is generated. Since the viscous fluid, solid grains or powder 5 as the absorber means is arranged between the column 4 and the container 6, the vibrations of the container 6, the steel cord 9 and the tail-line 8 are absorbed by a flow loss of the viscous fluid or solid grains or powder 5 caused by the relative motion between the column 4 and the container 6.

Figure 2:
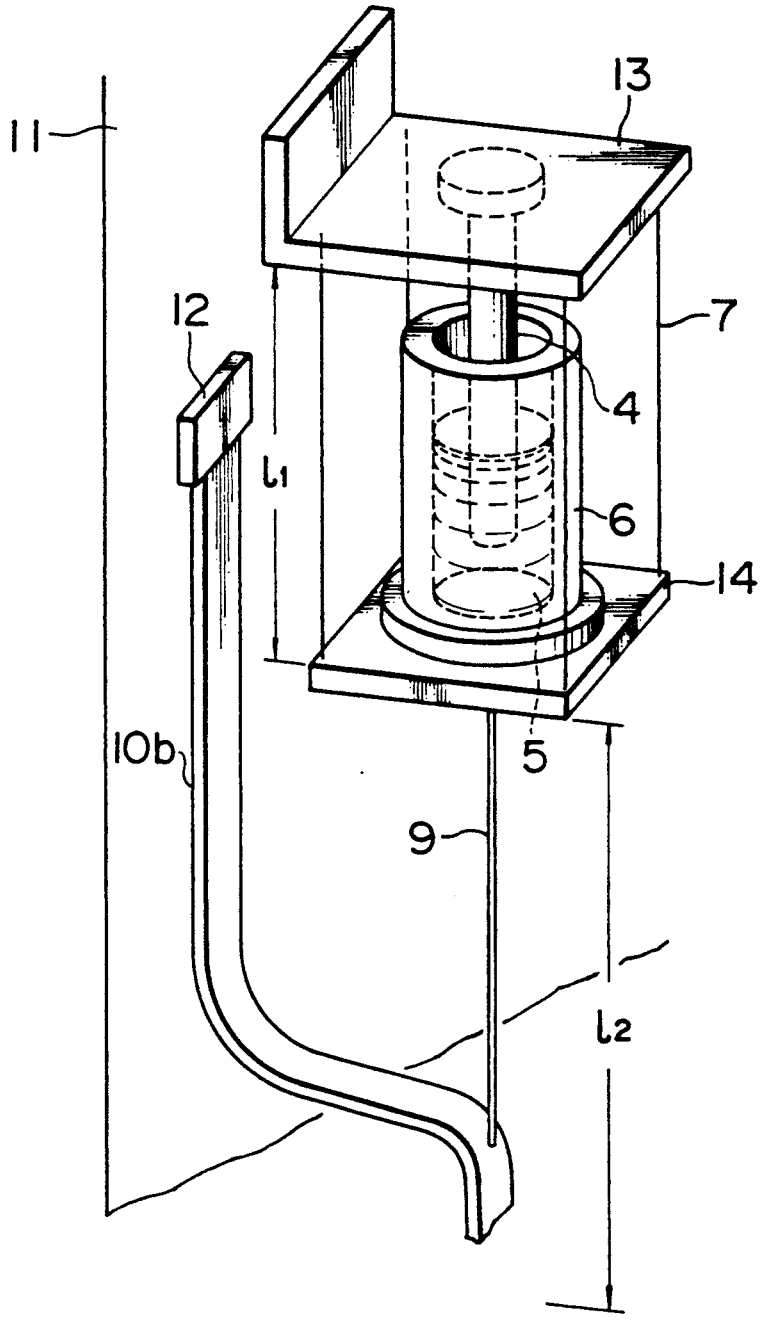
FIG. 2 is an oblique projection view showing another embodiment of the apparatus according to the present invention, in which apparatus a viscous fluid or solid grains or powder is used.

As shown in FIG. 2, the container 6 may be mounted on a support plate 14 suspended from the bottom surface of the bracket 13 through the suspender cords 7 in such a manner that a position of the container 6 can be easily adjusted relative to the support plate 14. In this embodiment, a positional relationship between the container 6 and the column 4 can be appropriately fixed.

A horizontal natural frequency f1 of the support plate 14 suspended from the bottom surface of the bracket 13 through the suspender cords 7 without the steel cord 9 and the tail-line 8 is calculated in accordance with the following equation, wherein a length of the suspender cords 7 is l1 and the acceleration of gravity is g:

$$f1 = 1/(2\pi(g/l1)^{178})$$

A horizontal natural frequency f2 of the tail-line 8 suspended from the support plate 14 through the steel cord 9 is calculated in accordance with the following equation, wherein a length between the bottom surface of the support plate 14 and the lowest point of the loop of the tail-line line 8 is l2 and the acceleration of gravity is g.

$$f2 = 1/(2\pi(g/l2)^{178})$$

The less a difference between the horizontal natural frequency f1 and the horizontal natural frequency f2 is, the greater a vibration energy transmitted from the tail-line 8 to the support plate 14, so that the vibration of the tail-line 8 is effectively absorbed by the viscous fluid, solid grains or powder 5.

Figure 3:
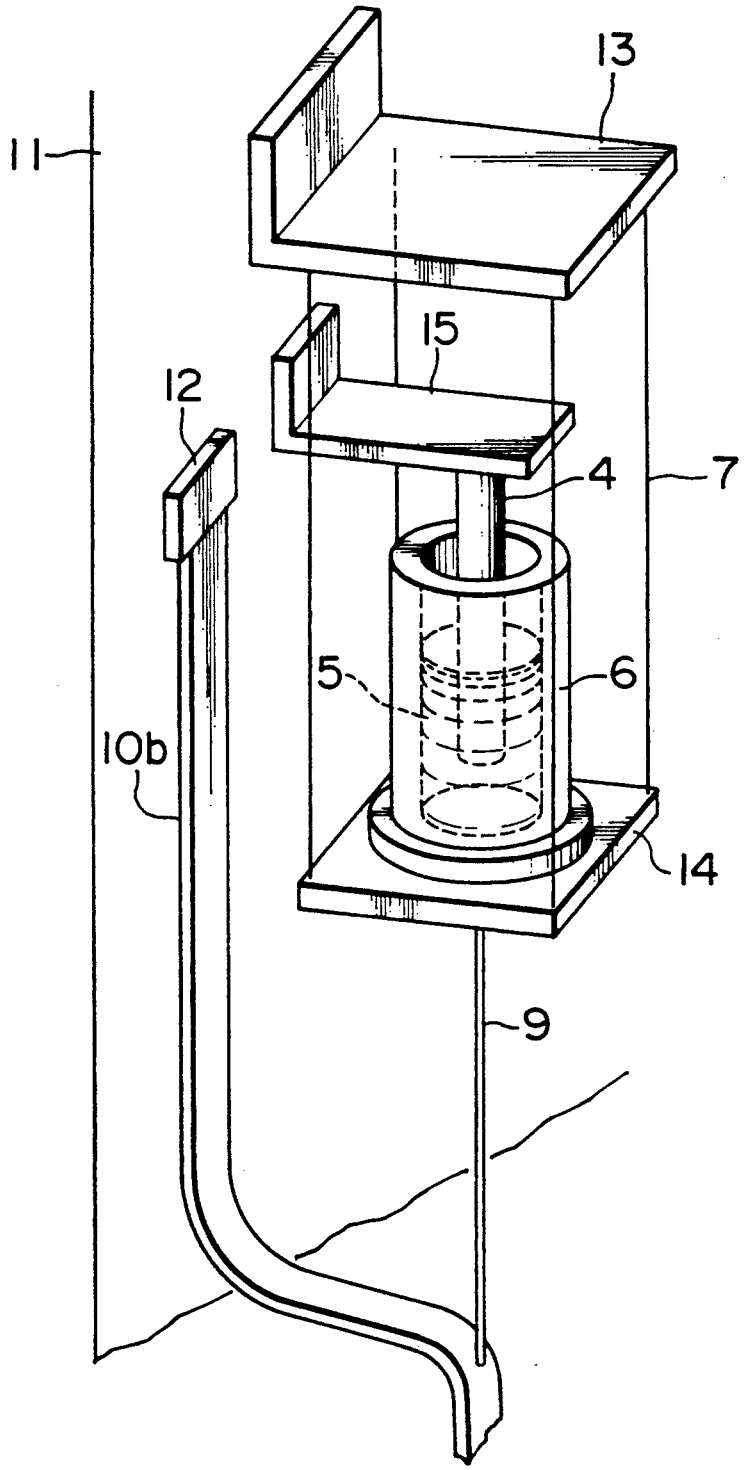
FIG. 3 is an oblique projection view showing another embodiment of the apparatus according to the present invention, in which apparatus a viscous fluid or solid grains or powder is used.
Figure 4:
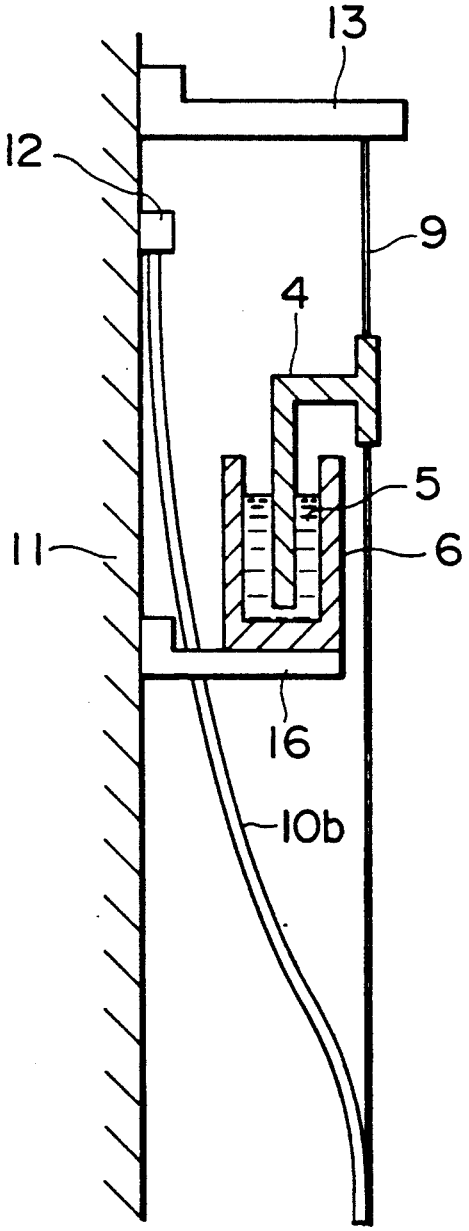
FIG. 4 is a partially cross-sectional view showing another embodiment of the apparatus according to the present invention, in which apparatus a viscous fluid or solid grains or powder is used.
Figure 5A:
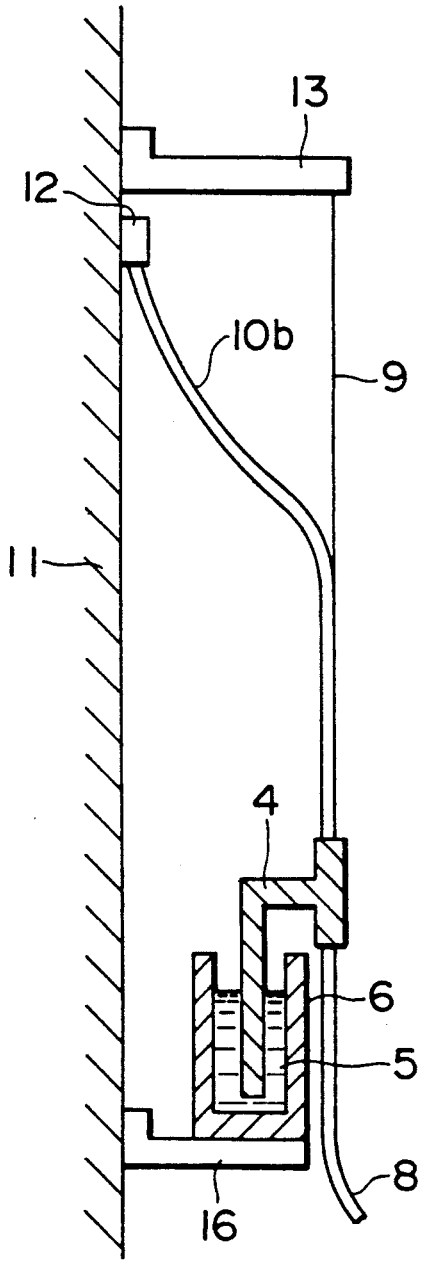
FIGS. 5A and 5B are partially cross-sectional views each of which shows another embodiment of the apparatus according to the present invention, in which apparatus a viscous fluid or solid grains or powder is used.
Figure 5B:
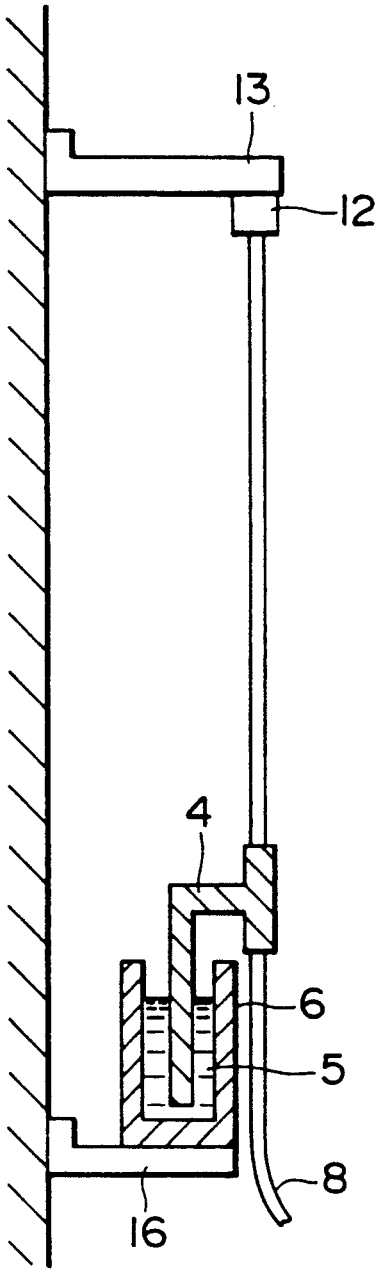

As shown in FIG. 3, the column 4 may be mounted on a bracket 15 fixed to the carriage path wall 11 under the bracket 13. In this embodiment, it can be obtained that the length of the suspender cords 7 is large for making the horizontal natural frequency f1 large and a length of the column 4 is small. As shown in FIG. 4, the steel cord 9 extending to the outside of the tail-line 8 may be directly connected to the bracket 13 and the container 6 may be mounted on a bracket 16 fixed to the carriage path wall 11 under the bracket 13. The column 4 is L-shaped to be fixed directly to the steel cord 9. As shown in FIG. 5A, the steel cord 9 extending to the outside of the tail-line 8 may be directly connected to the bracket 13, the container 6 may be mounted on the bracket 16 fixed to the carriage path wall 11 under the bracket 13, and the column 4 is L-shaped to be fixed directly to the tail-line 8. As shown in FIG. 5B, the tail-line 8 may be directly connected to the bracket 13 through the junction box 12 without the steel cord 9 extending to the outside of the tail-line 8, the container 6 may be mounted on the bracket 16 fixed to the carriage path wall 11 under the bracket 13, and the column 4 is L-shaped to be fixed directly to the tail-line 8. Arrangements similar to the above embodiments as shown in FIGS. 2–5B may be applied to the container 6 suspended from the carriage 1.

Figure 6:
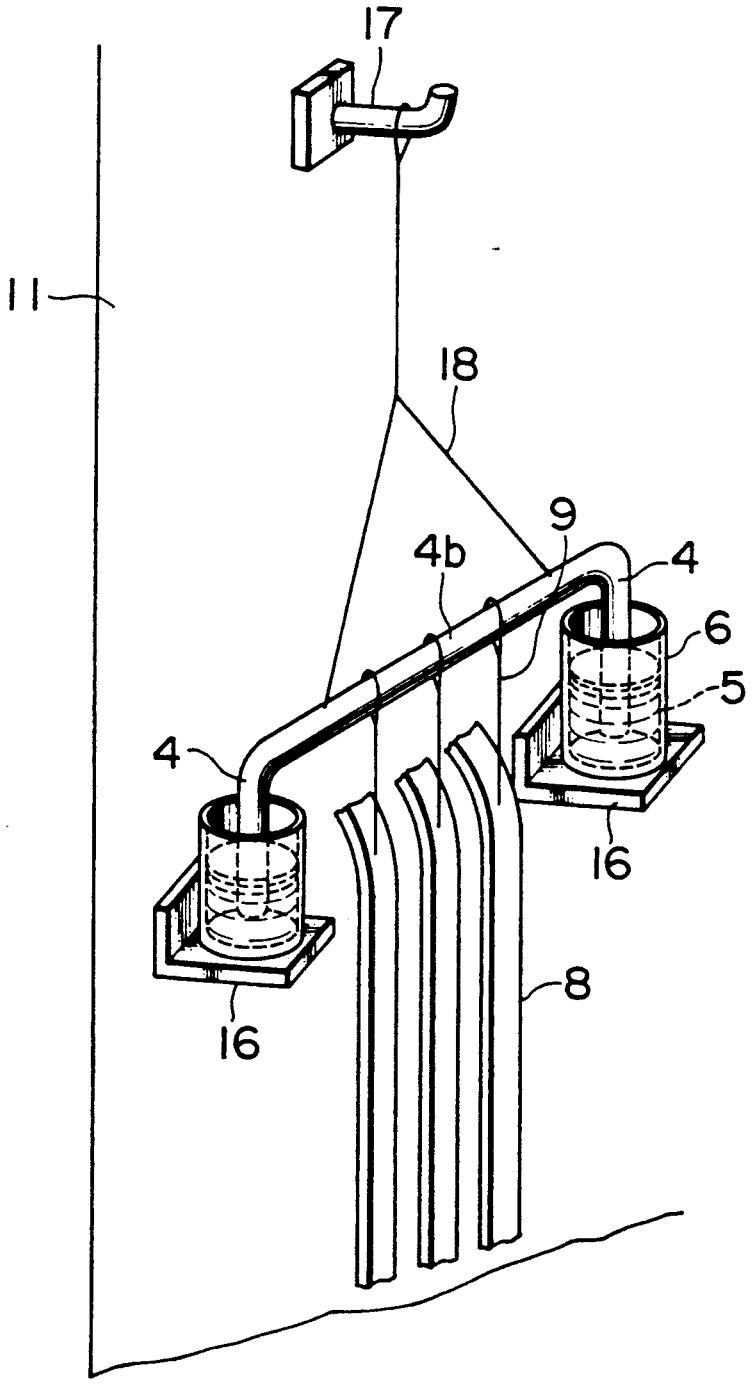
FIG. 6 is an oblique projection view showing another embodiment of the apparatus according to the present invention, in which apparatus a viscous fluid or solid grains or powder is used.

As shown in FIG. 6, a plurality of the tail-line 8 may be suspended from a support bar 4*b* through the steel cords 9 extending to the outside of the tail-lines 8, and the columns 4 may extend from respective longitudinal ends of the support bar 4*b* into the viscous fluid, solid grains or powder 5 accommodated in the containers 6. The containers 6 are mounted respectively on the brackets 16 fixed to the carriage path wall 11. The support bar 4*b* is suspended through a suspender cord 18 from a hook 17 fixed to the carriage path wall 11. The horizontal vibrations of the tail-lines 8 are transmitted to the columns 4 to be absorbed by the viscous fluid or solid grains or powder 5.

Figure 7:
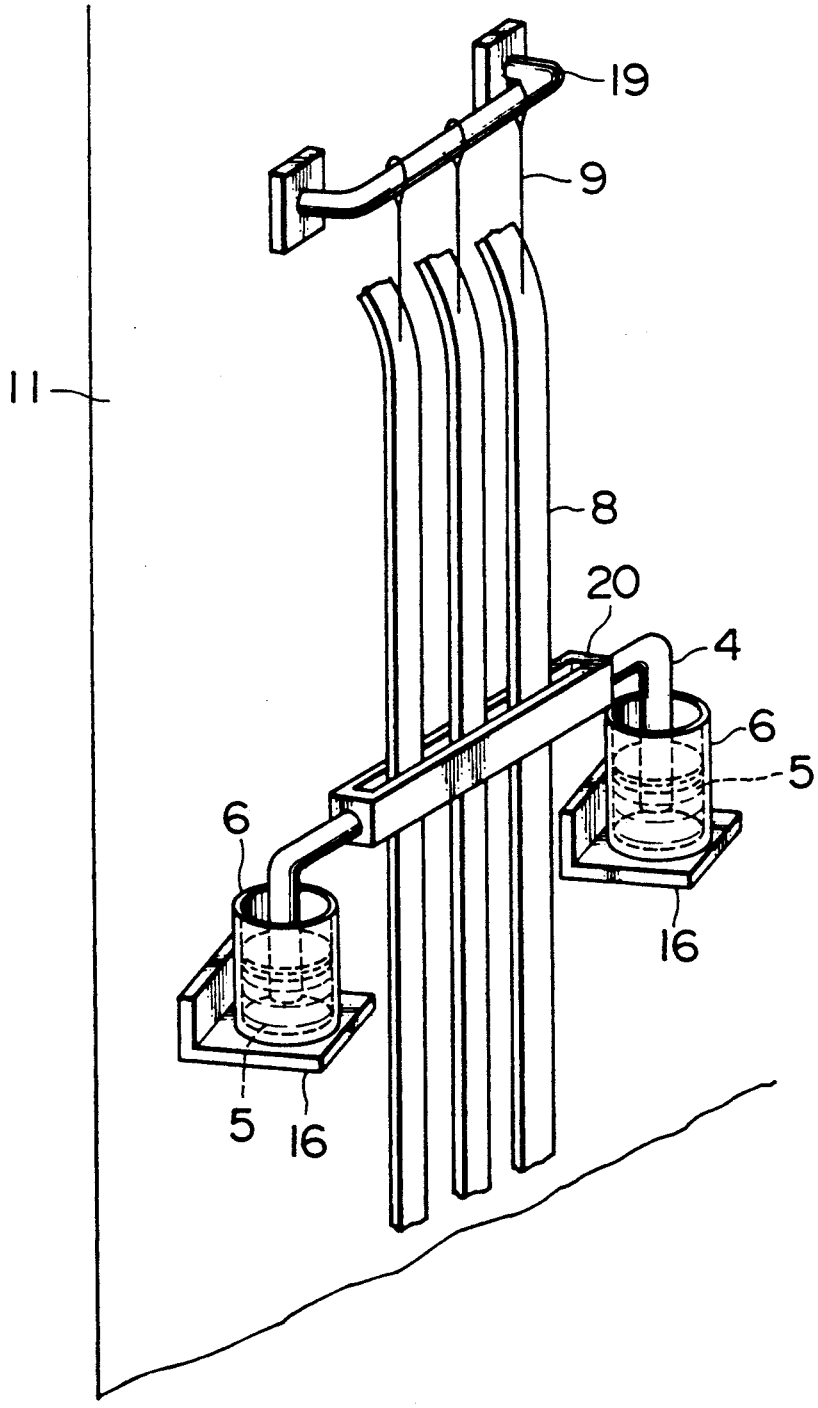
FIG. 7 is an oblique projection view showing another embodiment of the apparatus according to the present invention, in which apparatus a viscous fluid or solid grains or powder is used.
Figure 8:
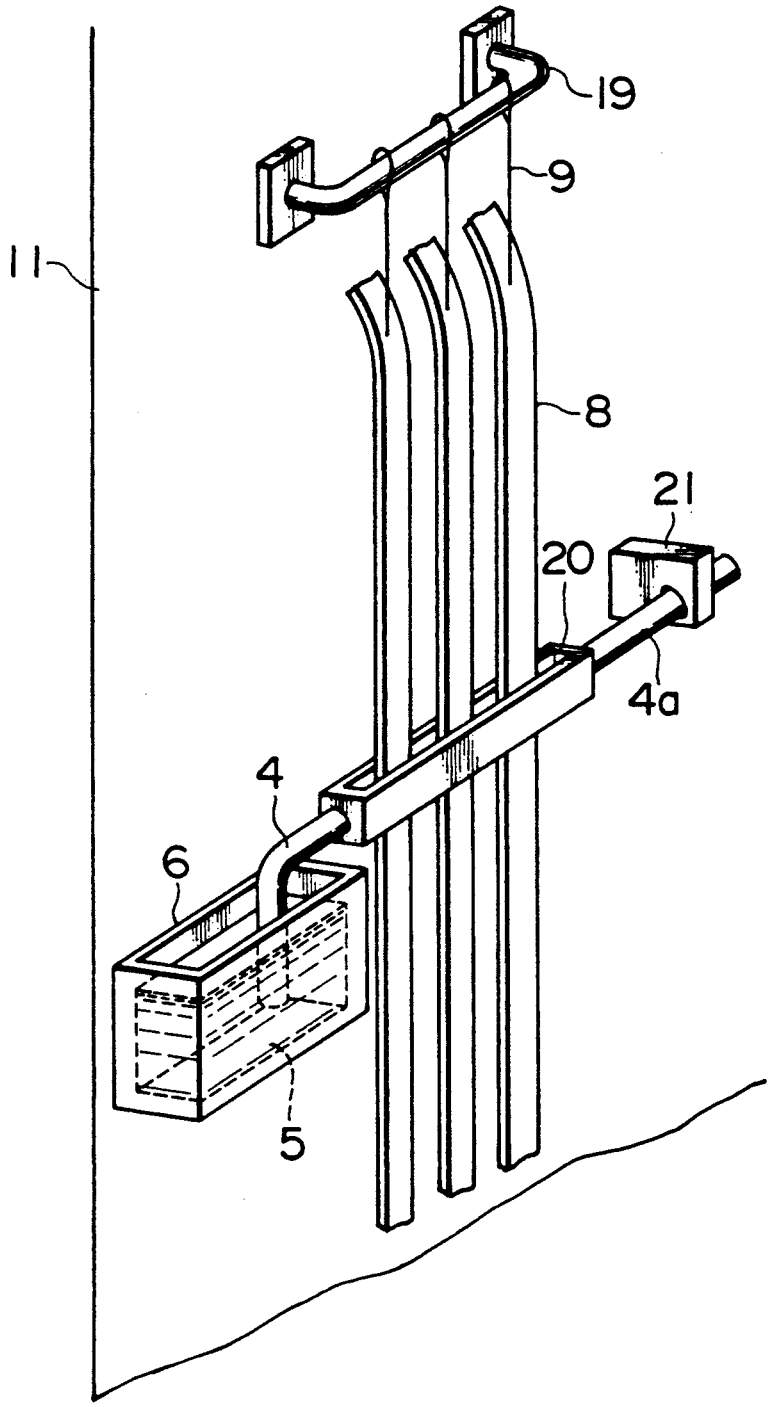
FIG. 8 is an oblique projection view showing another embodiment of the apparatus according to the present invention, in which apparatus a viscous fluid or solid grains or powder is used.

As shown in FIG. 8, the plurality of the tail-lines 8 may be suspended through the steel cords 9 from the support bracket 19 fixed to the carriage path wall 11, with the column 4 extending from the longitudinal end of the support frame 20 into the viscous fluid, solid grains or powder 5 accommodated in the containers 6, and with a longitudinal end 4*a* of the support frame 20 being slidable in a hole extending substantially parallel to the carriage path wall 11 in a guide bracket 21 fixed to the carriage path wall 11. The support frame 20 holds the tail-lines 8 so that the plurality of the tail-lines 8 move or vibrate unitedly. The containers 6 fixed to the carriage path wall 11 has a space which is elongated substantially parallel to the carriage path wall 11 and receives the viscous fluid, solid grains or powder 5. The horizontal vibrations of the tail-lines 8 are transmitted to the column 4 to be absorbed by the viscous fluid, solid grains or powder 5. Arrangements similar to the above embodiments as shown in FIGS. 6–8 may be applied to the container 6 suspended from the carriage 1.

Figure 9:
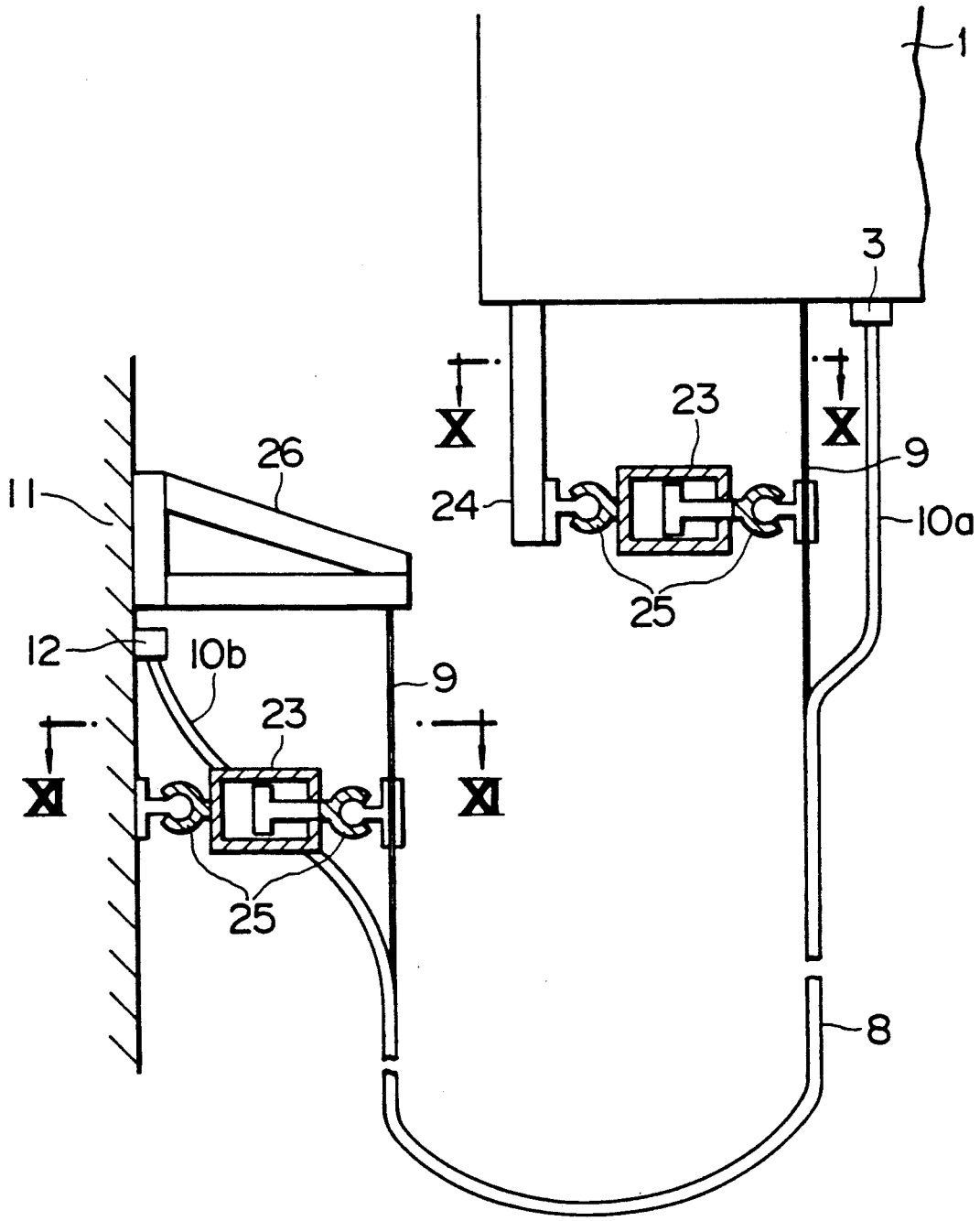
FIG. 9 is a partially cross-sectional view showing another embodiment of the apparatus according to the present invention, in which apparatus dashpots are used.

In another embodiment as shown in FIG. 9, the carriage 1 descends or ascends along the carriage path wall 11, the end 10*a* of the tail-line 8 is connected to the carriage 1 through the junction box 3 under the bottom surface of the carriage 1, and the another end 10*b* of the tail-line 8 is connected to the junction box 12 mounted on the carriage path wall 11. The steel cords 9 extend to the outside of the insulating cover of the tail-line 8 and are fixed respectively to the bottom surface of the carriage 1 and to a support bracket 26 fixed to the carriage path wall 11 so that the weight of the tail-line 8 is carried by the carriage 1 and the support bracket 26 through the steel cords 9 and the weight of the tail-line 8 is not transmitted to dashpots 23 each of which absorbs a vibration energy by reciprocating motion between longitudinal ends thereof as the absorber means and whose longitudinal ends are connected through respective universal joints 25 to the steel cords 9 and the extension bar 24 fixed to the carriage 1 and the carriage path wall 11. Since the longitudinal ends of each of the dashpots 23 are arranged in a horizontal direction substantially perpendicular to the carriage path wall 11 and are connected through the respective universal joints 25 to the steel cords 9, the extension bar 24 and the carriage path wall 11, a tension or vertical movement of the steel cords 9 extending vertically for bearing the weight of the tail-line 8 is not transmitted to the dashpots 23 and does not cause a variation of distance between the longitudinal ends of each of the dashpots 23. The steel cords 9 act as a support means. The ends 10*a* and 10*b* of the tail-line 8 have respective sufficient lengths or loops for preventing the vibration of the tail-line 8 from being transmitted to the carriage 1 and the carriage path wall 11 through the junction boxes 3 and 12. When the tail-line 8 vibrates horizontally and the steel cord 9 is vibrated horizontally by the tail-line 8, the reciprocating motions between the longitudinal ends of the dashpots 23 are generated. The vibration of the tail-line 8 is absorbed by a flow loss of viscous fluid or air in the dashpots 23.

Figure 10:
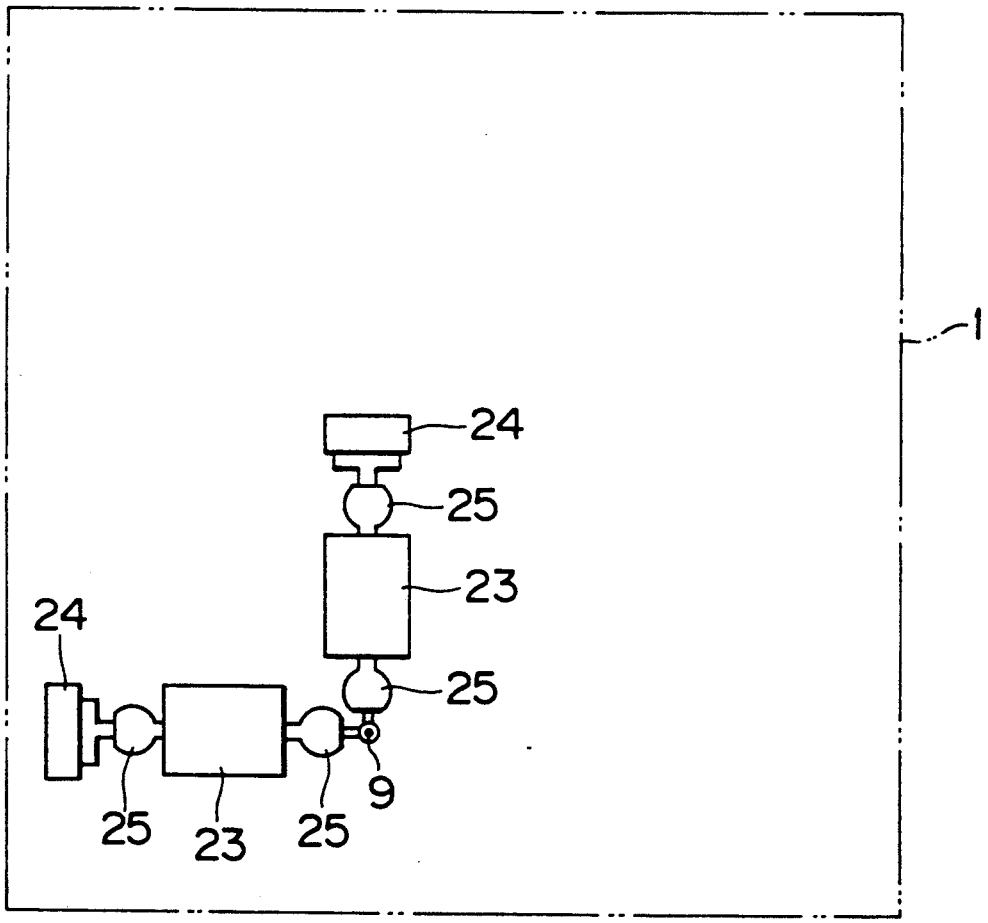
FIG. 10 is a cross-sectional view taken along a line X—X in FIG. 9.
Figure 11:
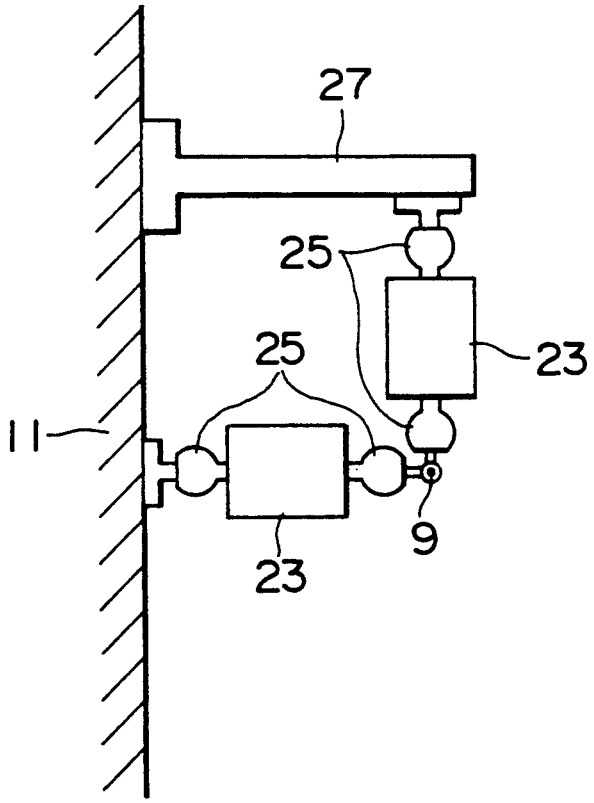
FIG. 11 is a cross-sectional view taken along a line XI—XI in FIG. 9.

As shown in FIG. 10, the longitudinal ends of another one of the dashpots 23 may be arranged in a horizontal direction substantially parallel to the carriage path wall 11 and may be connected through the respective universal joints 25 to the steel cords 9 and the extension bar 24. As shown in FIG. 11, the longitudinal ends of another one of the dashpots 23 may be arranged in a horizontal direction substantially parallel to the carriage path wall 11 and may be connected through the respective universal joints 25 to the steel cords 9 and an extension bar 27 fixed to the carriage path wall 11. Since the vibration of the tail-line 8 in the horizontal direction substantially perpendicular to the carriage path wall 11 is absorbed by a collision between the tail-line 8 and the carriage path wall 11, the longitudinal ends of each of the dashpots 23 connected to the carriage 1 and the carriage path wall 11 may be arranged only in the horizontal direction substantially parallel to the carriage path wall 11. Alternatively, the dashpot(s) 23 may be connected to only one of the carriage 1 and the carriage path wall 11.

Figure 12:
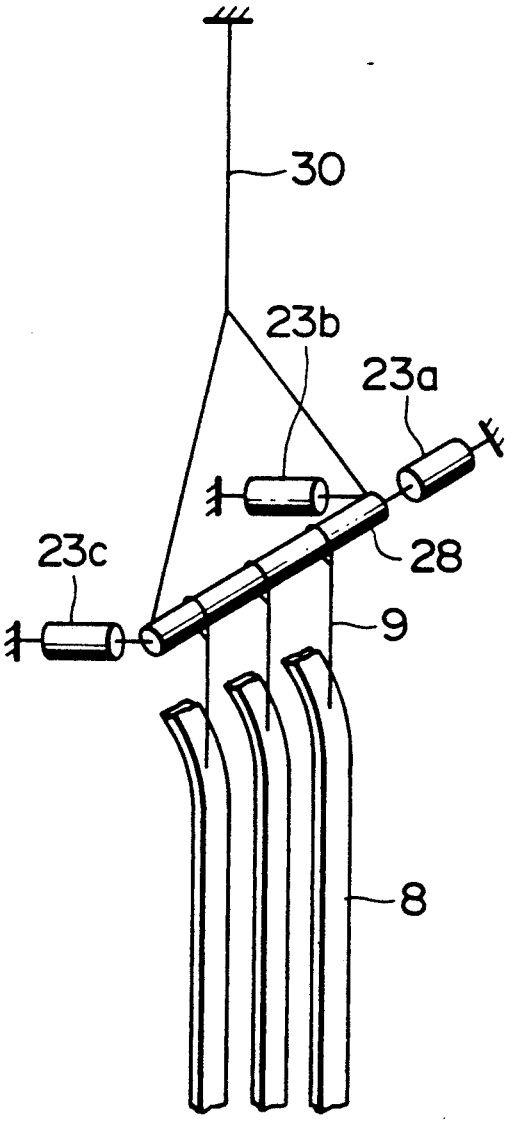
FIG. 12 is an oblique projection view showing another embodiment of the apparatus according to the present invention, in which apparatus dashpots are used.
Figure 13:
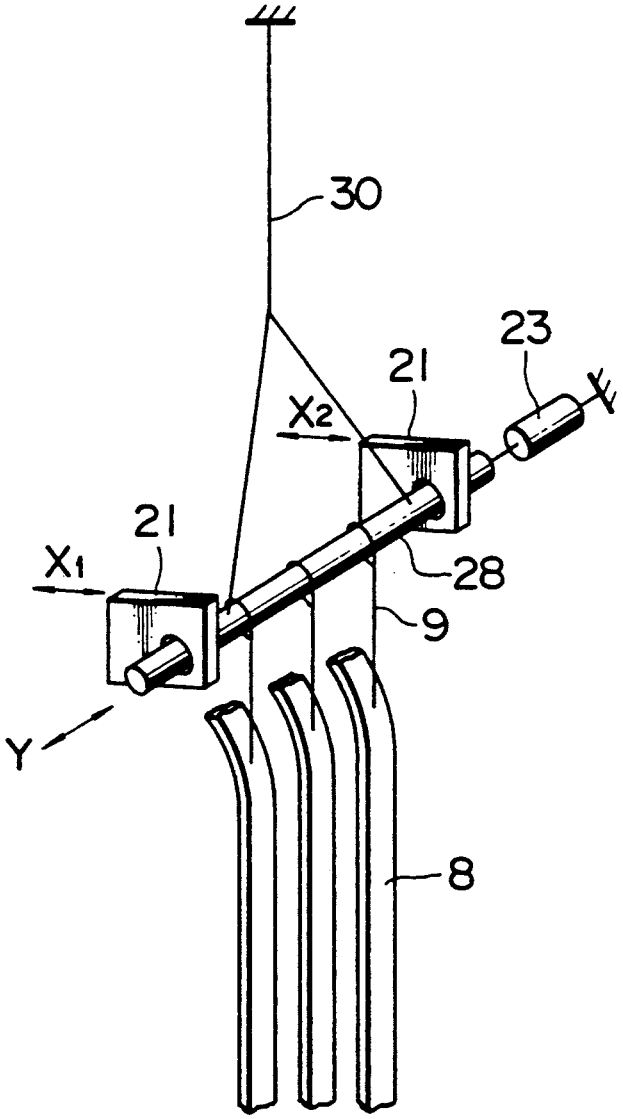
FIG. 13 is an oblique projection view showing another embodiment of the apparatus according to the present invention, in which apparatus dashpots are used.
Figure 14:
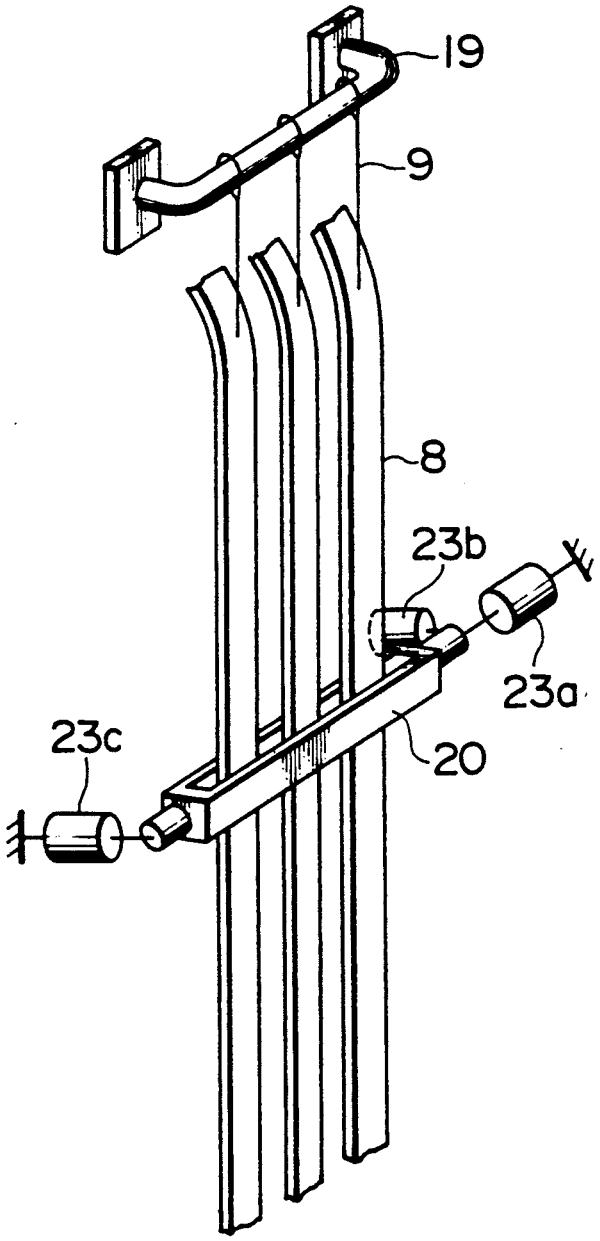
FIG. 14 is an oblique projection view showing another embodiment of the apparatus according to the present invention, in which apparatus dashpots are used.
Figure 15:
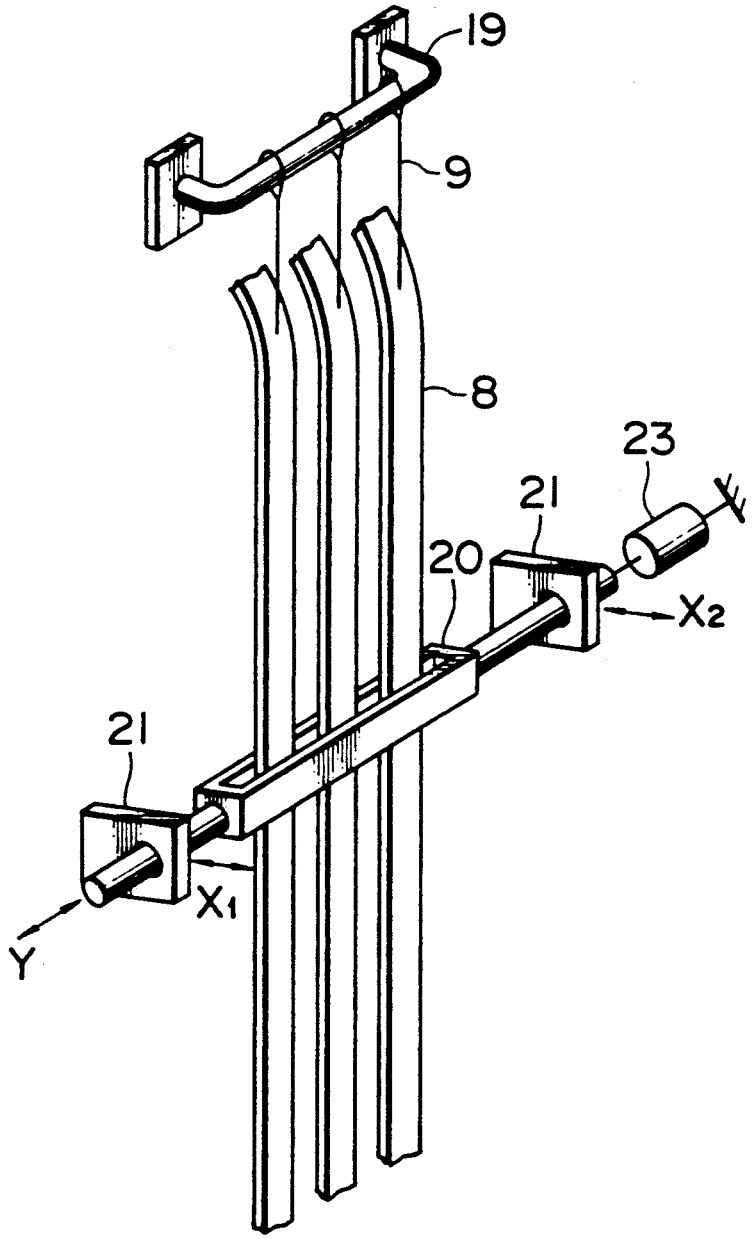
FIG. 15 is an oblique projection view showing another embodiment of the apparatus according to the present invention, in which apparatus dashpots are used.

In an embodiment as shown in FIG. 12, the plurality of the tail-lines 8 are suspended through the steel cords 9 from a support rod 28 which is suspended through a suspender cord 30 and extends substantially parallel to the carriage path wall 11. Longitudinal ends of the support rod 28 are connected to the dashpots 23*b* and 23*c* whose longitudinal ends are arranged in the horizontal direction substantially perpendicular to the carriage path wall 11, and one of the longitudinal ends of the support rod 28 is connected to the dashpot 23*a* whose longitudinal ends are arranged in the horizontal direction substantially parallel to the carriage path wall 11. In the embodiment shown in FIG. 13, the plurality of the tail-lines 8 are suspended through the steel cords 9 from the support rod 28 which is supported in the holes extending substantially parallel to the carriage path wall 11 in the guide brackets 21 to prevent a vibration of the support rod 28 in the horizontal direction $X_1$ and $X_2$ substantially perpendicular to the carriage path wall 11, is suspended through the suspender cord 30 and extends substantially parallel to the carriage path wall 11. One of the longitudinal ends of the support rod 28 is connected to the dashpot 23 whose longitudinal ends are arranged in the horizontal direction Y substantially parallel to the carriage path wall 11. In the embodiment shown in FIG. 14, the plurality of the tail-lines 8 are suspended through the steel cords 9 from the support bracket 19 fixed to the carriage path wall 11 and are held by the support frame 20 so that the plurality of the tail-lines 8 move or vibrate unitedly. The longitudinal ends of the support frame 20 are connected to the dashpots 23*b* and 23*c* whose longitudinal ends are arranged in the horizontal direction substantially perpendicular to the carriage path wall 11, and one of the longitudinal ends of the support rod 28 is connected to the dashpot 23*a* whose longitudinal ends are arranged in the horizontal direction substantially parallel to the carriage path wall 11. In the embodiment of FIG. 15, the plurality of the tail-lines 8 are suspended through the steel cords 9 from the support bracket 19 fixed to the carriage path wall 11 and are held by the support frame 20 so that the plurality of the tail-lines 8 move or vibrate unitedly. The support frame 20 is supported in the holes extending substantially parallel to the carriage path wall 11 in the guide brackets 21 to prevent a vibration of the support rod 28 in the horizontal direction $X_1$ and $X_2$ substantially perpendicular to the carriage path wall 11 and extends substantially parallel to the carriage path wall 11. One of the longitudinal ends of the support frame 20 is connected to the dashpot 23 whose longitudinal ends are arranged in the horizontal direction Y substantially parallel to the carriage path wall 11. The longitudinal ends of each of the dashpots 23 have the universal joints respectively so that only a compression and tension are applied to the dashpots 23 without an application of bending moment to the dashpots 23. It is preferable for a length of the suspender cord 30 to be as much as possible.

Figure 16:
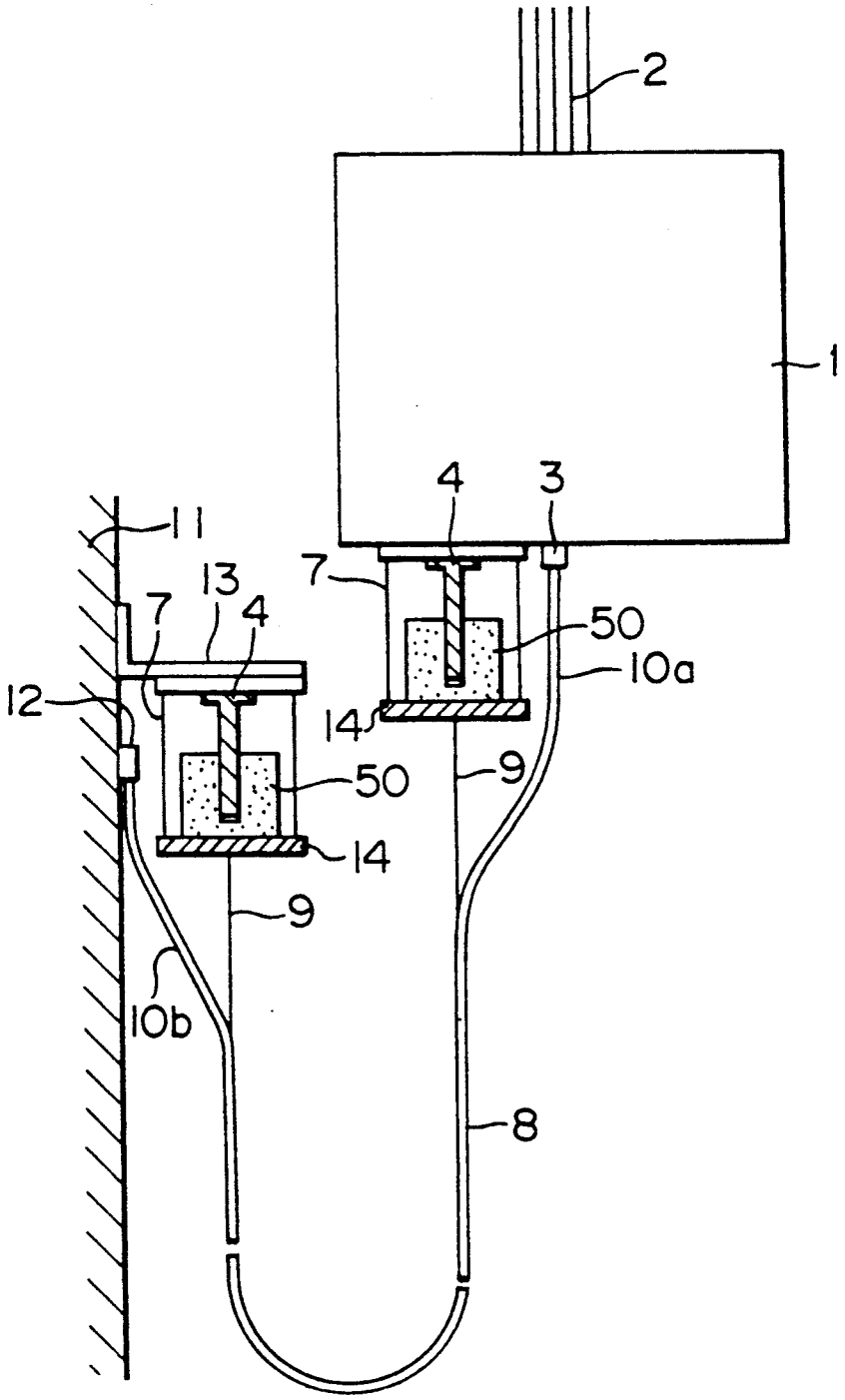
FIG. 16 is a partially cross-sectional view showing another embodiment of the apparatus according to the present invention, in which apparatus visco-elastic bodies are used.
Figure 17:
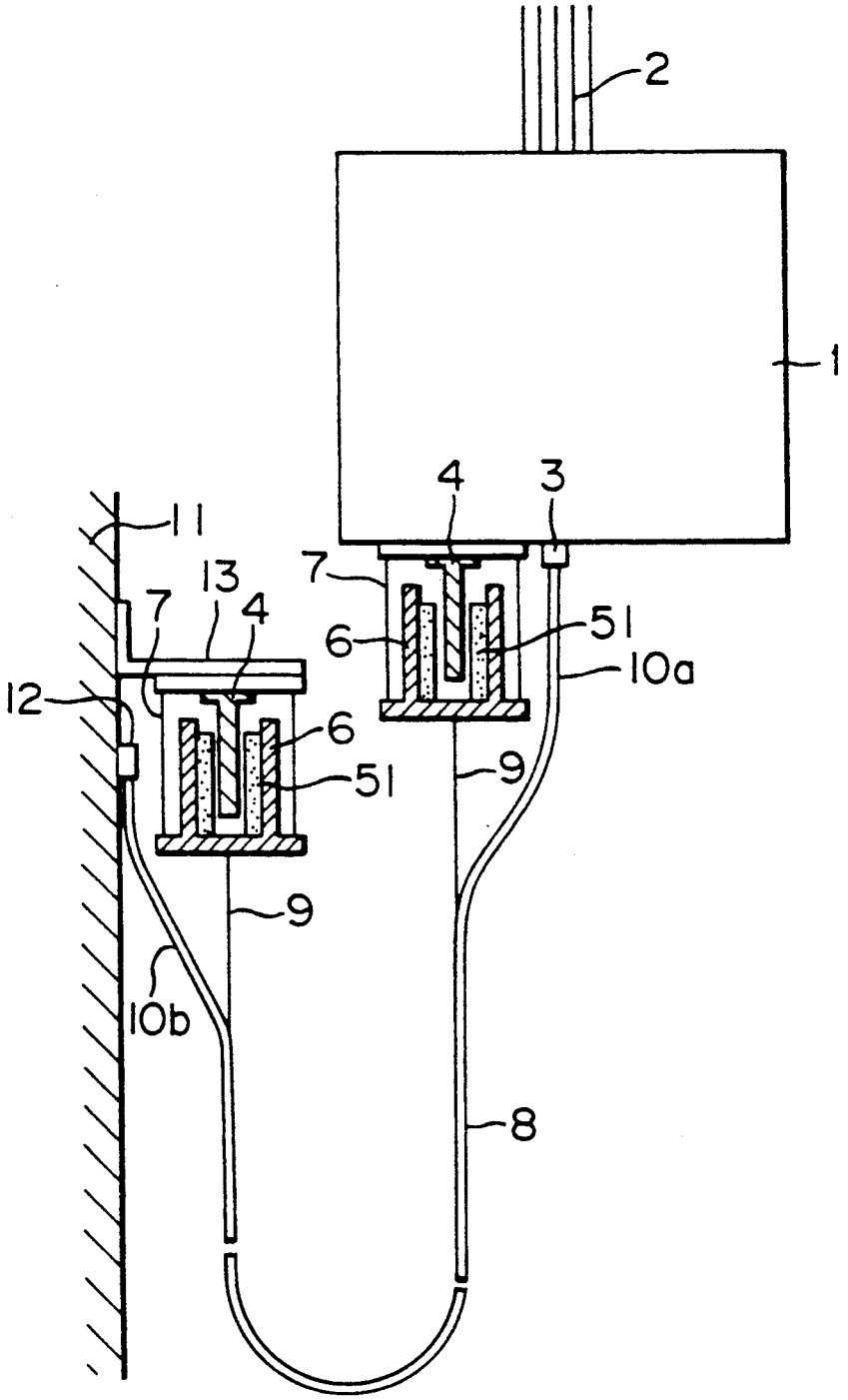
FIG. 17 is a partially cross-sectional view showing another embodiment of the apparatus according to the present invention, in which apparatus elastic hysteresis bodies are used.
Figure 18:
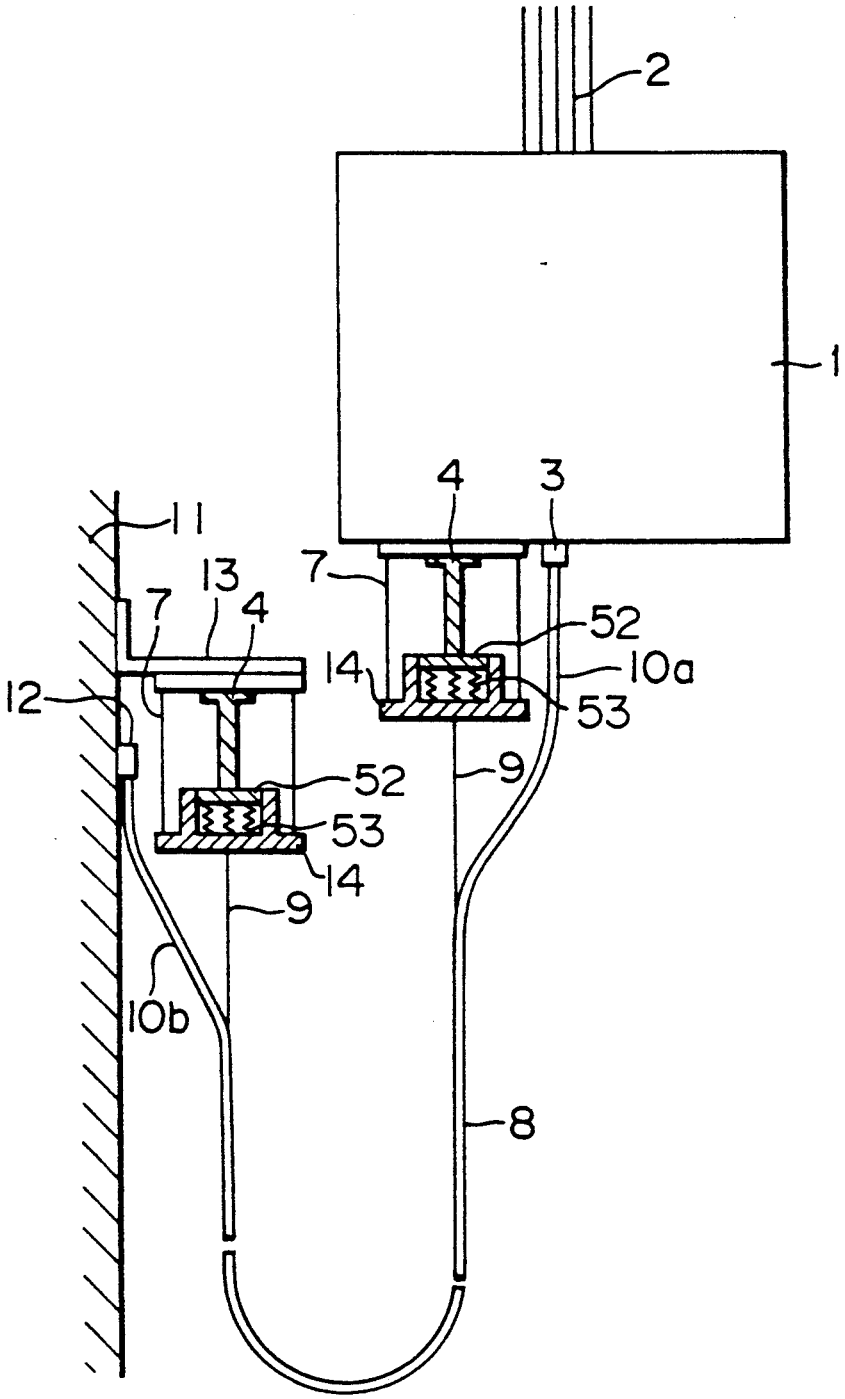
FIG. 18 is a partially cross-sectional view showing another embodiment of the apparatus according to the present invention, in which apparatus frictional members are pressed against each other by springs.
Figure 19:
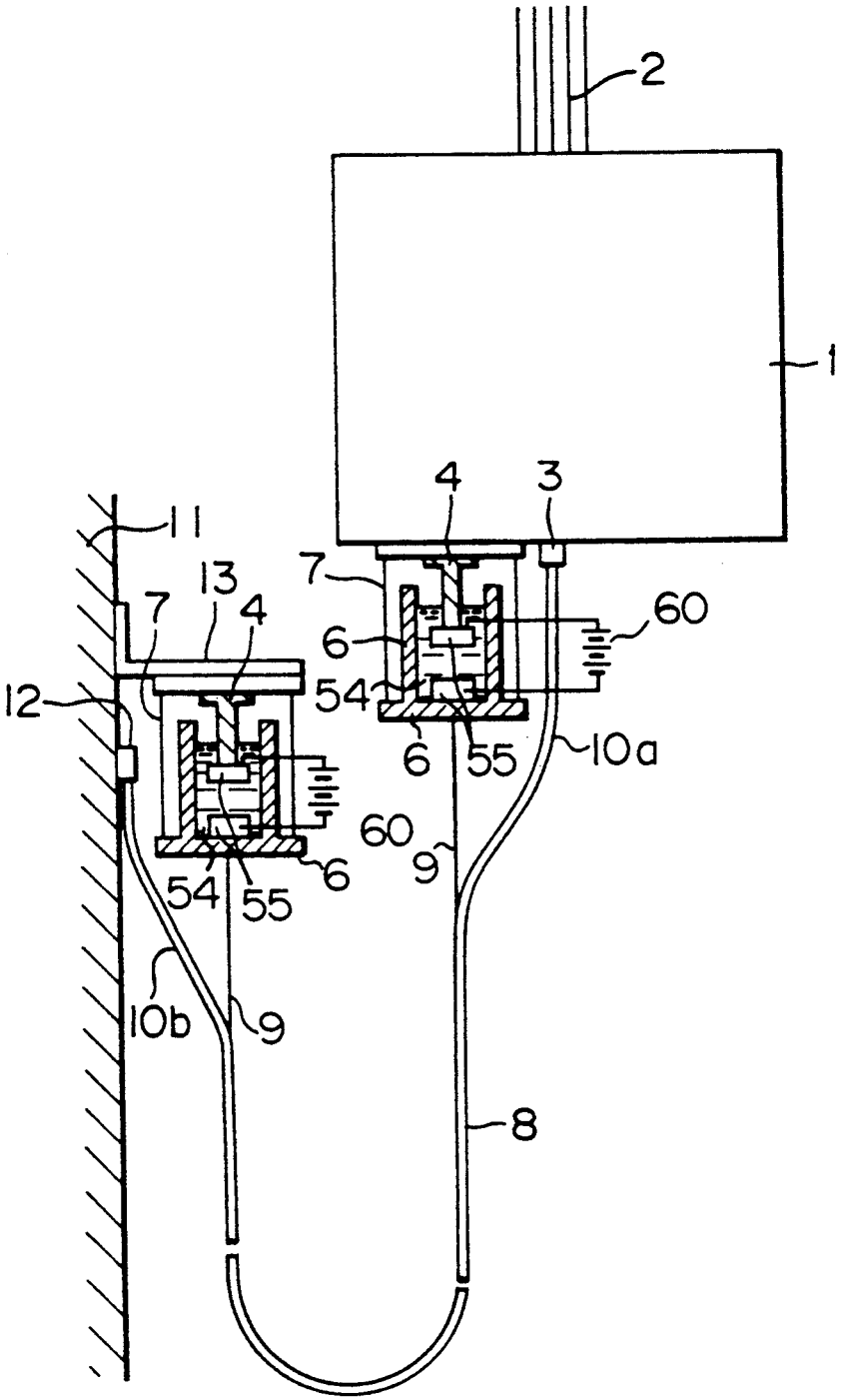
FIG. 19 is a partially cross-sectional view showing another embodiment of the apparatus according to the present invention, in which apparatus a viscosity of electro-rheological fluid is controlled by a voltage variation between electrodes.
Figure 20:
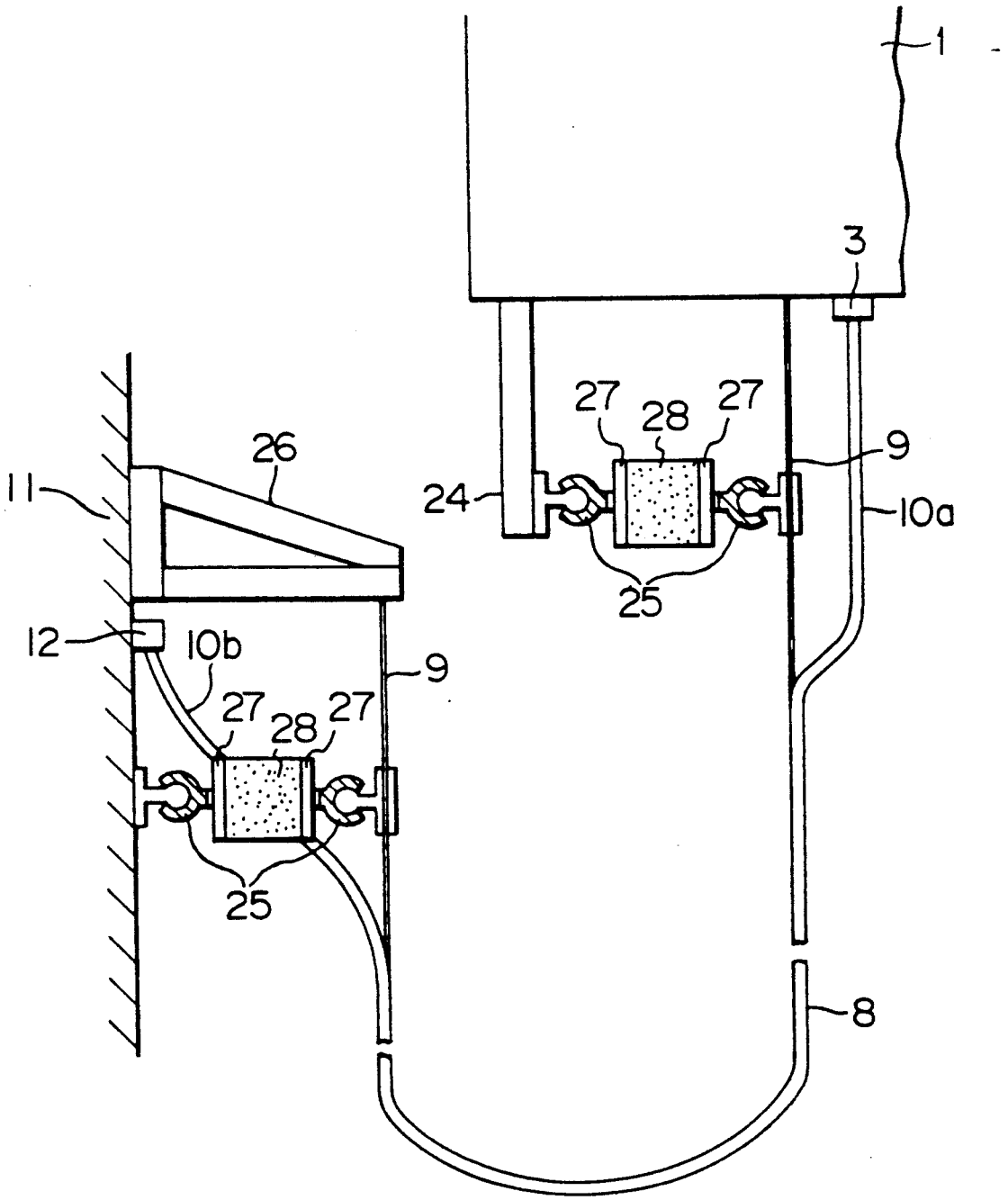
FIG. 20 is a partially cross-sectional view showing another embodiment of the apparatus according to the present invention, in which apparatus elastic hysteresis bodies are used.
Figure 21:
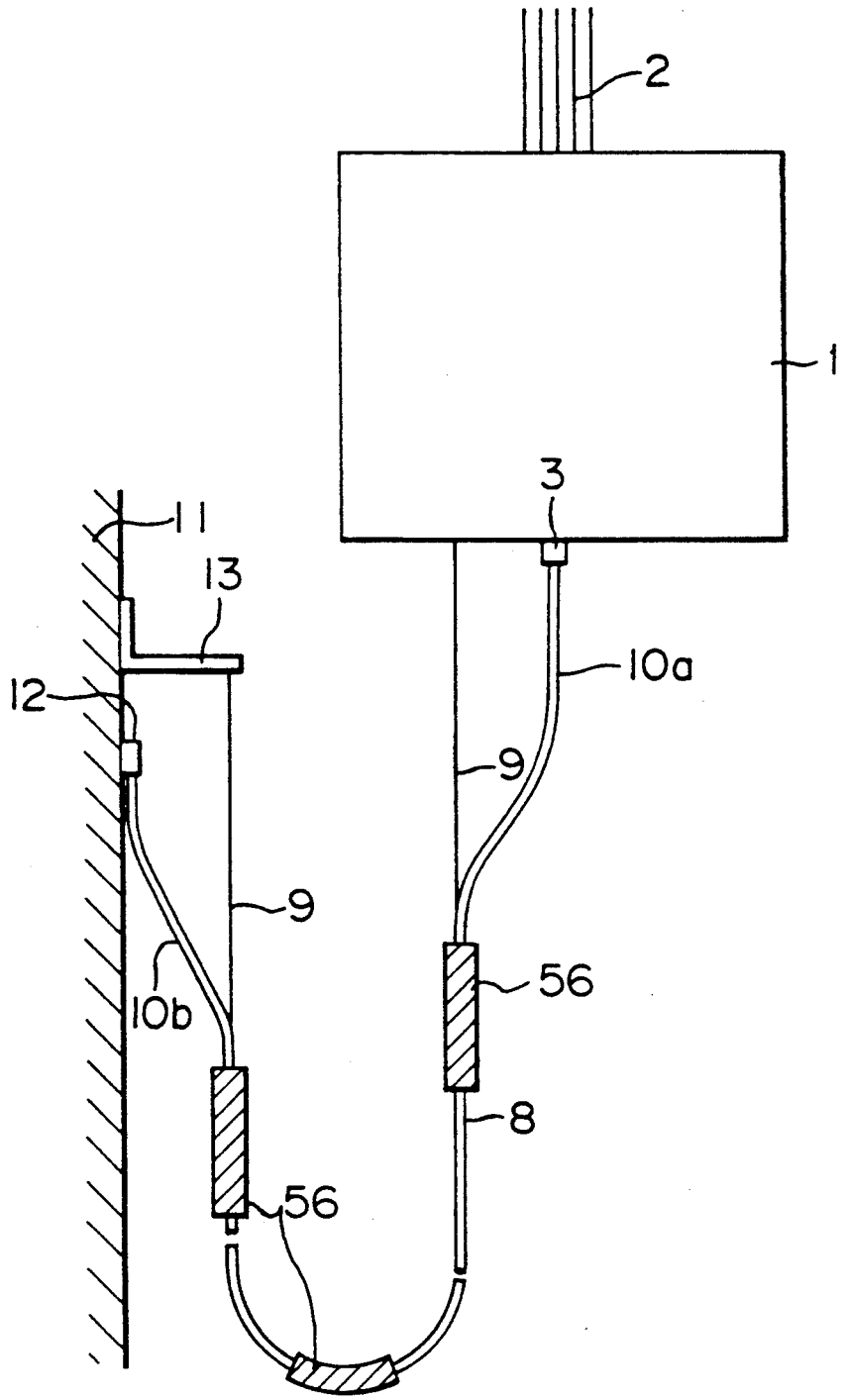
FIG. 21 is a schematic view showing another embodiment of the apparatus according to the present invention, in which apparatus visco-elastic rubber bodies cover the tail-line.
Figure 22:
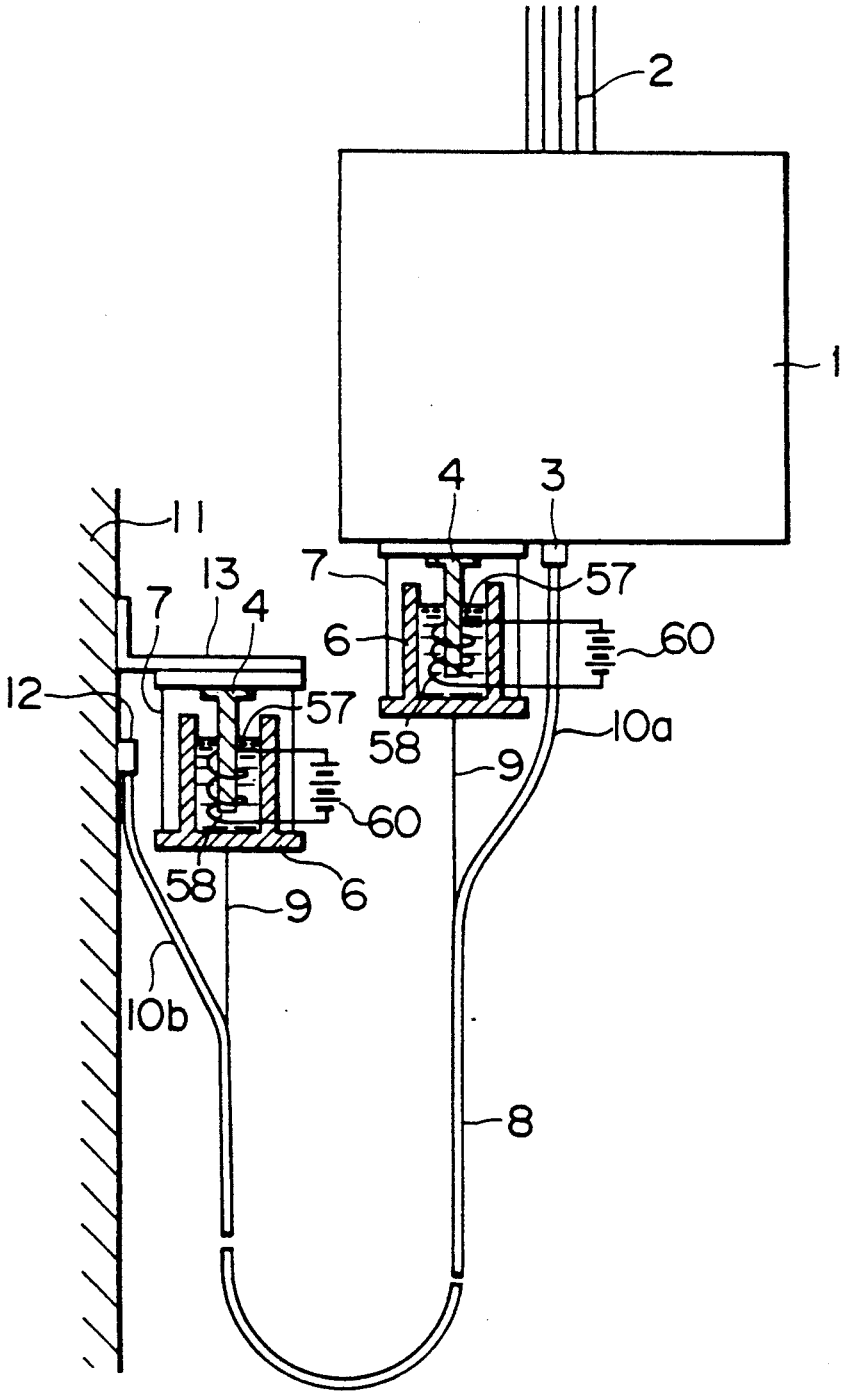
FIG. 22 is a partially cross-sectional view showing another embodiment of the apparatus according to the present invention, in which apparatus a magnetically permeable powder is magnetized by an electro-magnetic coil.

As shown in FIG. 16, instead of the viscous fluid, solid grains or powder 5, a visco-elastic rubber member 50 is arranged between the column 4 and the support plate 14 may be used as the absorber means. It is preferable that a compression is applied to the visco-elastic rubber member 50 by a combination of the column 4 and the support plate and a tension for bearing the weight of the tail-line 8 is not applied to the visco-elastic rubber member 50 thereby. As shown in FIG. 17, instead of the viscous fluid, solid grains or powder 5, an elastic hysteresis plate 51 may be arranged between the column 4 and the container 6 may be used as the absorber means. The vibration of the tail-line 8 is absorbed by a hysteresis loss generated on a collision between the column 4 and the elastic hysteresis plate 51. As shown in FIG. 18, instead of the viscous fluid, solid grains or powder 5, a frictional plate 52, supported in a sliding fit manner relative to the support plate 14 and pressed upwardly against the column 4 by springs 53, may be used as the absorber means. The vibration of the tail-line 8 is absorbed by a frictional loss between the column 4 and the frictional plate 52. As shown in FIG. 19, instead of the viscous fluid, solid grains or powder 5, an electro-rheological fluid 54 may be used as the absorber means. A viscosity of the electro-rheological fluid 54 is changed in accordance with a variation of voltage between electrodes 55 one of which is fixed to an forward end of the column 4 and another one of which is fixed to the container 6. The electrodes 55 are energized by electrical power suppliers 60. The vibration of the tail-line 8 is absorbed by a viscous loss between the electrodes 55 in the electro-rheological fluid 54. As shown in FIG. 20, instead of the dashpots 23, visco-elastic rubber bodies 28 arranged between support plates 27 fixed to the universal joints 25 respectively may be used as the absorber means. The vibration of the tail-line 8 is absorbed by a visco-elastic loss of the visco-elastic rubber bodies 28 between the universal joints 25. As shown in FIG. 21, instead of the viscous fluid, solid grains or powder 5 and the dashpots 23, visco-elastic rubber covers 56 which surrounding the tail-line 8 may be used as the absorber means. The visco-elastic rubber covers 56 are mounted on the tail-line 8 in such a manner that the weight of the tail-line 8 is not transmitted to the visco-elastic rubber covers 56. The vibration of the tail-line 8 is absorbed by a visco-elastic loss of the visco-elastic rubber bodies 56. As shown in FIG. 22, instead of the viscous fluid, solid grains or powder 5, a magnetically permeable fluidal powder or magnetic fluid 58 may be used as the absorber means. A viscosity of the magnetically permeable fluidal powder or magnetic fluid 58 is changed in accordance with a strength of magnetic field generated by electro-magnetic coils 57 which are arranged in the container 6 respectively and are energized by the electrical power suppliers 60. The vibration of the tail-line 8 is absorbed by a viscous loss between the column 4 and the container 6 in the magnetically permeable powder or magnetic fluid 58.

What is claimed is:

1. An apparatus for preventing a vibration of an elevator tail-line having a first stationarily held end and a second end connected to an elevator carriage to move together therewith, the apparatus comprising:

absorber means, in addition to said elevator tail-line, for absorbing a vibration of the elevator tail-line, said absorber means being substantially stationary relative to the elevator tail-line in a longitudinal direction of the elevator tail-line during ascent and descent of the elevator carriage, and support means for bearing a weight of the elevator tail-line to prevent a weight of the elevator tail-line from being applied to the absorber means so that the absorber means does not bear a weight of the elevator tail-line.

2. An apparatus according to claim 1, further comprising a first member connected to the elevator tail-line to be moved thereby and a second member connected to the elevator carriage which does not vibrate together with the elevator tail-line, and wherein the absorber means is a viscous fluid arranged between the first member and the second member.

3. An apparatus according to claim 1, further comprising a first member connected to the elevator tail-line to be moved thereby and a second member connected to the elevator carriage which does not vibrate together with the elevator tail-line, and wherein the absorber means is fluidal powder arranged between the first member and the second member.

4. An apparatus according to claim 1, further comprising a first member connected to the elevator tail-line to be moved thereby and a second member connected to the elevator carriage which does not vibrate together with the elevator tail-line, and wherein the absorber means is visco-elastic member arranged between the first member and the second member.

5. An apparatus according to claim 1, further comprising a first member connected to the elevator tail-line to be moved thereby and a second member connected to the elevator carriage which does not vibrate together with the elevator tail-line, and wherein the absorber means includes an elastic hysteresis member arranged between the first member and the second member.

6. An apparatus according to claim 1, further comprising a first member connected to the elevator tail-line to be moved thereby and a second member connected to the elevator carriage which does not vibrate together with the elevator tail-line, and wherein the absorber means includes a frictional member arranged between the first member and the second member so that a frictional loss is generated on the frictional member by a relative movement between the first member and the second member.

7. An apparatus according to claim 1, further comprising a first member connected to the elevator tail-line to be moved thereby and a second member connected to the elevator carriage which does not vibrate together with the elevator tail-line, and wherein the absorber means includes a dashpot comprising an orifice through which a fluid flow generated by a relative movement between the first member and second member passes.

8. An apparatus according to claim 1, further comprising a first member connected to the elevator tail-line to be moved thereby and a second member connected to the elevator carriage which does not vibrate together with the elevator tail-line, and wherein the absorber means magnetically permeable powder arranged between the first member and the second member, said magnetically permeable powder having a viscosity which is changed in accordance with a strength of magnetic field applied to the magnetically permeable powder.

9. An apparatus according to claim 1, further comprising a first member connected to the elevator tail-line to be moved thereby and a second member connected to the elevator carriage which does not vibrate together with the elevator tail-line, and wherein the absorber means includes an electro-rheological fluid arranged between the first member and the second member, said electro-rheological fluid has a viscosity which is changed in accordance with a strength of an electric field applied to the electro-rheological fluid.

10. An apparatus according to claim 1, further comprising a first member connected to the elevator tail-line to be moved thereby and a second member connected to the elevator carriage which does not vibrate together with the elevator tail-line, and wherein the absorber means includes a magnetic fluid arranged between the first member and the second member, said magnetic fluid having a viscosity which is changed in accordance with a strength of magnetic field applied to the magnetic fluid.

11. An apparatus according to claim 1, wherein the absorber means includes a visco-elastic member arranged on the elevator tail-line.

12. An apparatus according to claim 1, further comprising a universal joint between the elevator tail-line and the absorber means.

13. An apparatus according to claim 1, further comprising a universal joint between the elevator carriage and the absorber means.

14. An apparatus according to claim 1, further comprising a universal joint having a first end connected to the absorber means and a second stationarily held end.

15. An apparatus according to claim 1, wherein the vibration of the elevator tail-line is transmitted to the absorber means through the support means.

16. An apparatus according to claim 1, wherein the vibration of the elevator tail-line is transmitted directly from the tail-line to the absorber means.

17. An apparatus according to claim 1, wherein the vibration of the elevator tail-line in a horizontal direction is absorbed by the absorber means.

18. An apparatus according to claim 1, further comprising a frame for holding a plurality of the elevator tail-lines, and wherein the absorber means is connected to the elevator tail-lines through the frame.

19. An apparatus according to claim 1, further comprising a support member for supporting a plurality of the support means, and wherein the absorber means is connected to a plurality of the elevator tail-lines through the support member and the support means.

20. An apparatus according to claim 1, further comprising a first member connected to the elevator tail-line to be moved thereby and a second member connected to the elevator carriage which does not vibrate together with the elevator tail-line, wherein the absorber means arranged between the first member and the second member absorbs the vibration of the elevator tail-line with a relative movement between the first member and the second member, and wherein a natural frequency of the second member is substantially equal to that of the elevator tail-line.

* * * * *